United States Patent [19]

Eaton

[11] Patent Number: 4,771,835

[45] Date of Patent: Sep. 20, 1988

[54] DOWNHOLE HAMMER

[75] Inventor: Ronald E. Eaton, Midvale, Australia

[73] Assignee: Wallis Drilling Pty. Ltd., Midvale, Australia

[21] Appl. No.: 61,320

[22] PCT Filed: Sep. 2, 1986

[86] PCT No.: PCT/AU86/00259

§ 371 Date: May 1, 1987

§ 102(e) Date: May 1, 1987

[87] PCT Pub. No.: WO87/01413

PCT Pub. Date: Mar. 12, 1987

[30] Foreign Application Priority Data

Sep. 2, 1985 [AU] Australia ..... PH2250

[51] Int. Cl.[4] ..... E21B 4/14

[52] U.S. Cl. ..... 175/92; 173/64; 173/78; 173/80; 175/100; 175/215; 175/296; 175/324

[58] Field of Search ..... 175/92, 100, 296, 215, 175/324; 173/80, 73, 78, 79, 64

[56] References Cited

U.S. PATENT DOCUMENTS

| | | | |
|---|---|---|---|
| 3,198,264 | 8/1965 | Oelke et al. | 173/78 X |
| 3,225,841 | 12/1965 | Thompson | 173/73 X |
| 3,795,283 | 3/1974 | Oughton | 175/92 X |
| 3,924,690 | 12/1975 | Shaw | 173/80 X |
| 3,941,196 | 3/1976 | Curington et al. | 175/100 |
| 4,321,974 | 3/1982 | Klemm | 175/92 |
| 4,509,606 | 4/1985 | Willis | 175/215 X |

*Primary Examiner*—Hoang C. Dang

*Attorney, Agent, or Firm*—Harness, Dickey & Pierce

[57] ABSTRACT

A down hole hammer comprising a substantially cylindrical casing having a top sub at one end and a drill bit support at the other; a central passageway extending through the top sub, casing and drill bit support; a central tube coaxial with the casing and extending from the bottom of the top sub to the top of the bit support thereby defining an annular space between its outer surface and the internal face of the casing, its inner bore forming part of the central passageway; an annular piston reciprocatively accommodated within the annular space for movement between an impact position at which said piston abuts the drill bit support, and a raised position at which said piston is spaced from the drill bit support; fluid porting being provieded to said annular space to effect the reciprocation of the piston between the raised and impact positions, the exhaust from the annular space during reciprocation of the piston being exhausted into the central passageway; a fluid by-pass extending between the top sub and the drill support and having an outlet opening into the central passageway of the drill bit support and being directed towards the top sub.

6 Claims, 6 Drawing Sheets

DOWNHOLE HAMMER

BACKGROUND OF THE INVENTION

This invention relates to down hole hammers which may be used in drilling holes in any direction.

Throughout the specification reference may be made to particular directional orientations of components and/or movement of components however it should be appreciated that such reference is for the purpose of explanation only and is not intended to be taken as limiting the scope or application of the items being described.

SUMMARY OF THE INVENTION

In one form the invention resides in a down hole hammer comprising a substantially cylindrical casing having a top sub at one end and a drill bit support at the other, a central tube extending through the top sub, casing and a drill bit support to define and enclose annular space between the internal face of the casing the external face of the central tube, an annular piston reciprocately accommodated within the annular space for movement between an impact position at which said piston abutts said drill bit support and a raised position at which said piston is spaced from the drill bit support, fluid porting means being provided to said annular space to effect the reciprocation of the piston between the raised and impact position, the exhaust from the annular space during reciprocation of the piston being exhausted into the central tube, a fluid bypass extending between the top sub and the drill bit support and having an outlet openning into the central tube of the drill bit support and being directed towards the top sub.

BRIEF DESCRIPTION OF THE DRAWINGS

The invention will be more fully understood in the light of the following description of one specific embodiment. The description is made with reference to the accompanying drawings of which

DETAILED DESCRIPTION OF THE PREFERRED EMBODIMENT OF THE INVENTION

Figure 1:
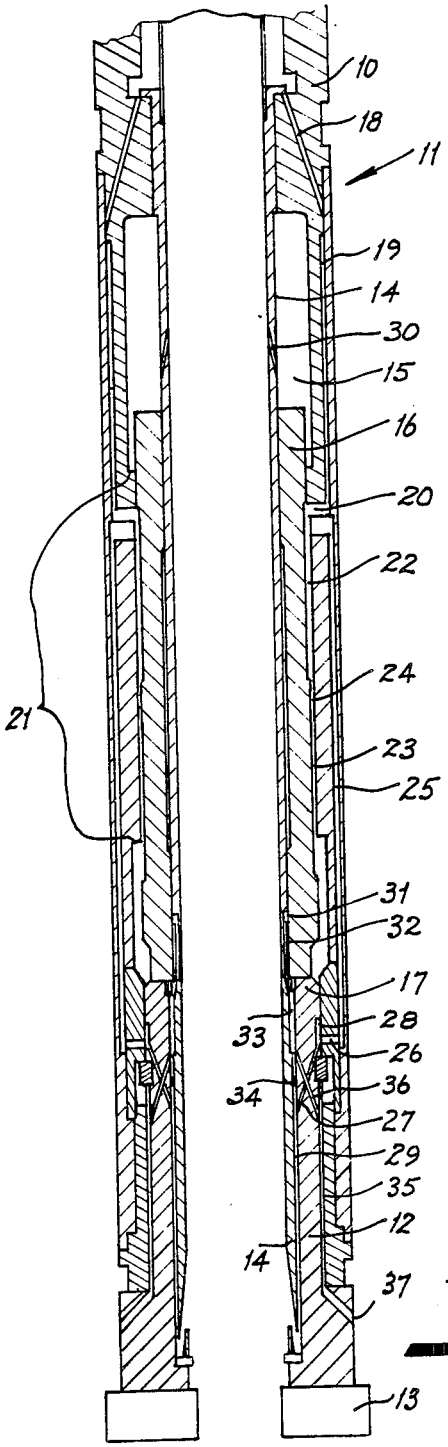
FIG. 1 is a schematic sectional elevation of a down hole hammer according to the embodiment with the piston in the impact position.
Figure 3:
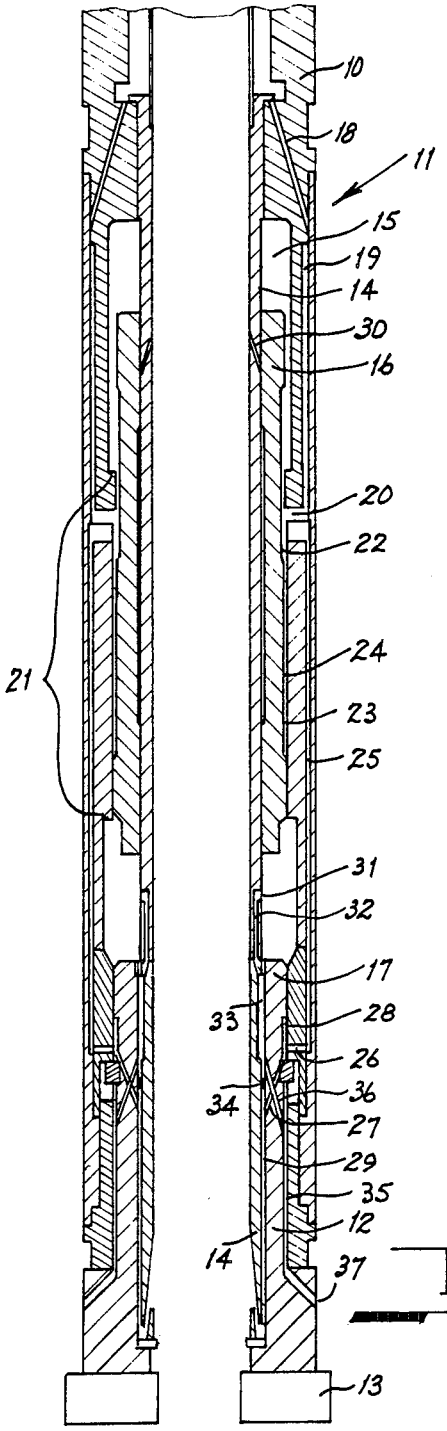
FIG. 3 is a sectional elevation of the hammer of FIGS. 1 and 2 with the piston in the raised position.

The embodiment is directed towards a down hole hammer comprising a top sub 10 connected to a cylindrical casing 11 which slidably supports a drill bit support 12 (which term includes the drill chuck) at its other end. The lower end of the drill bit support 12 accommodates a drill bit 13 which is shown schematically. The drill bit support accommodates an inner liner 24 which defines a central passageway therein while the drill bit 13 is formed with a central axial passsageway. The casing 11 also supports a central tube 14 which extends from the top sub through the casing and extends past the upper end of the inner liner 24 of the drill bit support to surround the inner end of the drill bit support. The central tube 14 is spaced a small distance from the exterior of the upper end of the inner liner 24 to define a first exhaust 15 for the annular space defined between the internal face of the casing 11 and the central tube 14. The annular space accommodates an annular piston 16 which is slidably received between the casing and the central tube to reciprocate between an impact position as shown at FIG. 1 at which the lower end of the piston impacts against the uppermost end or anvil 17 of the drill bit support as shown in FIG. 1 and a raised position at which the upper end of the piston is adjacent the upper end of the annular space as shown at FIG. 3.

The upper end of the inner liner 24 of the drill bit support extends beyond the drill bit support 12 whereby its external face is sealingly engaged by the piston 16 when the piston is in its impact position (FIG. 1) and for a portion of its upward movement from its impact position. The uppermost end of the inner liner 24 is of reduced diameter and terminates just short of the lower end of the central tube 14 to define the first exhaust 15.

Figure 2:
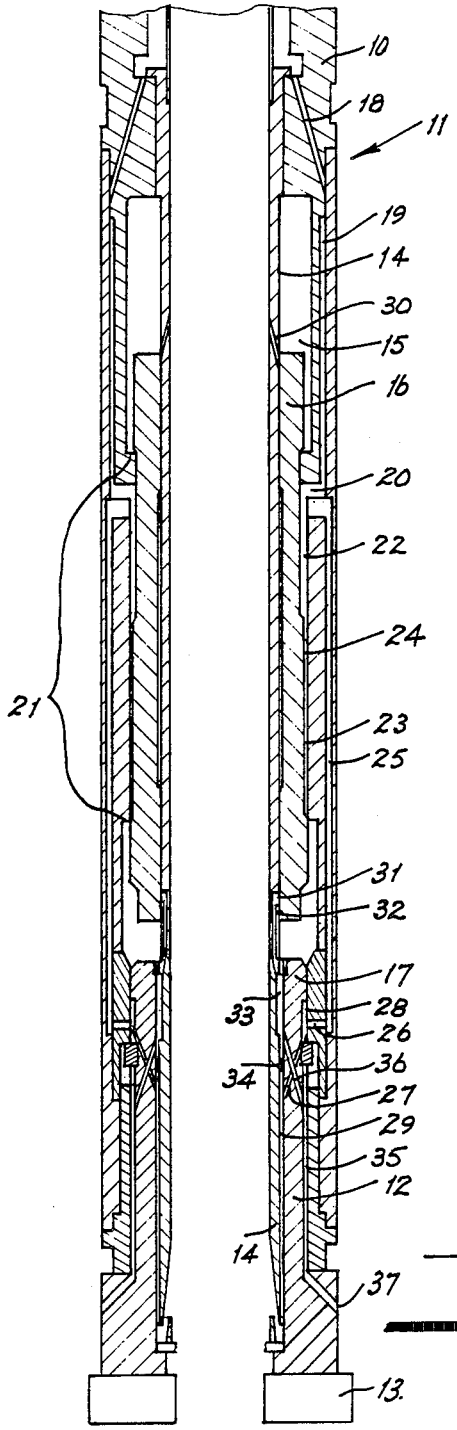
FIG. 2 is a schematic sectional elevation of the hammer of FIG. 1 with the piston at an intermediate position.

The upper end of the annular space is defined at its inner bore by an exhaust tube 30 which extends partially into the annular space from the top sub and concentrically surrounds the central tube 14. Exhaust from the upper end of the annular space is effected through the annular passage between the exhaust tube 30 and the central tube 14 which defines a second exhaust 31 and which opens at its upper end into the central passageway through the top sub 10. During reciprocation of the piston 16 in the annular space the exhaust tube 30 is engaged by the piston at an intermediate position of the piston to close off the upper portion of the annular space (as shown at FIG. 2). Exhaust from the space defined between the anvil 17 of the drill bit support 12 and the lower end of the piston 16 is effected through the first exhaust 15. Fluid from both the first and second exhausts 15 and 31 enters the central passageway in a direction parallel to the fluid flow therein which results from the fluid bypass the annular space and enters the central passageway at the annular opening 28 at the lower end of the hammer. In addition at the opening of the first and second exhausts into the central passageway the passageway increases in diameter which results in a ventrui like effect to draw exhausted fluid from the respective exhausts. In addition the entry of the exhausted fluid serves in maintaining the velocity of the fluid flow within the passageway thus ensuring the continued suspension of cuttings.

To effect reciprocation of the piston 16 within the annular space fluid is supplied to that space from the top sub through a series of circumferentially spaced ports in the top sub 10 which open into an annular passageway 19 between an outer and inner portion 11*a* and 11*b* respectively of the casing 11. The passageway opens into the upper portion of the annular space through a series of circumferentially spaced first inlet ports 20 in the inner portion 11*a* of the casing. Fluid is supplied to the lower portion of the annular space through a second set of inlet ports 32. The external face of the piston 16 is dimensioned to be slidably and sealingly received by the internal face of the inner portion of the casing 11*b*. The piston however is formed with a waisted portions 21 and 22 at its upper and lower end respectively which each connect with the adjacent end of the piston through a respective set of ports 23. The waisted portions 21 and 22 of the piston 16 engage with the first and second set of inlet ports 20 and 32 respectively when the piston moves to its upper and lower most positions respectively in the casing.

The axial extent of the first inlet ports 20 may vary such that the amount of communication to the upper annular space is at a maximum when the piston is at its upper most position in the space and diminishes as the piston moves from its upper most position.

Figure 4:
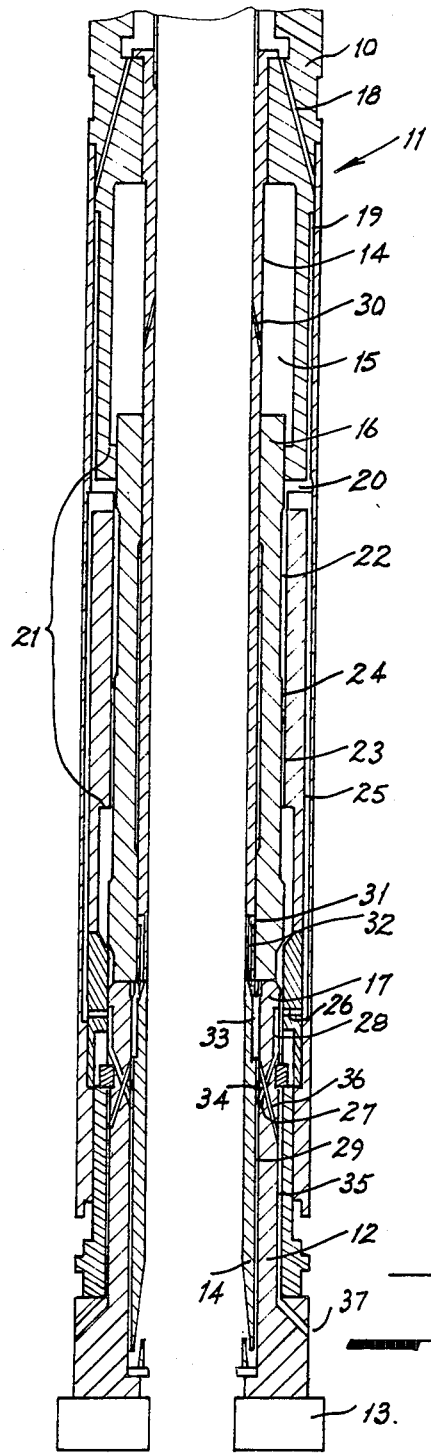
FIG. 4 is a schematic elevation of the hammer of FIGS. 1, 2 and 3 in the "blow down" position.
Figure 5A:
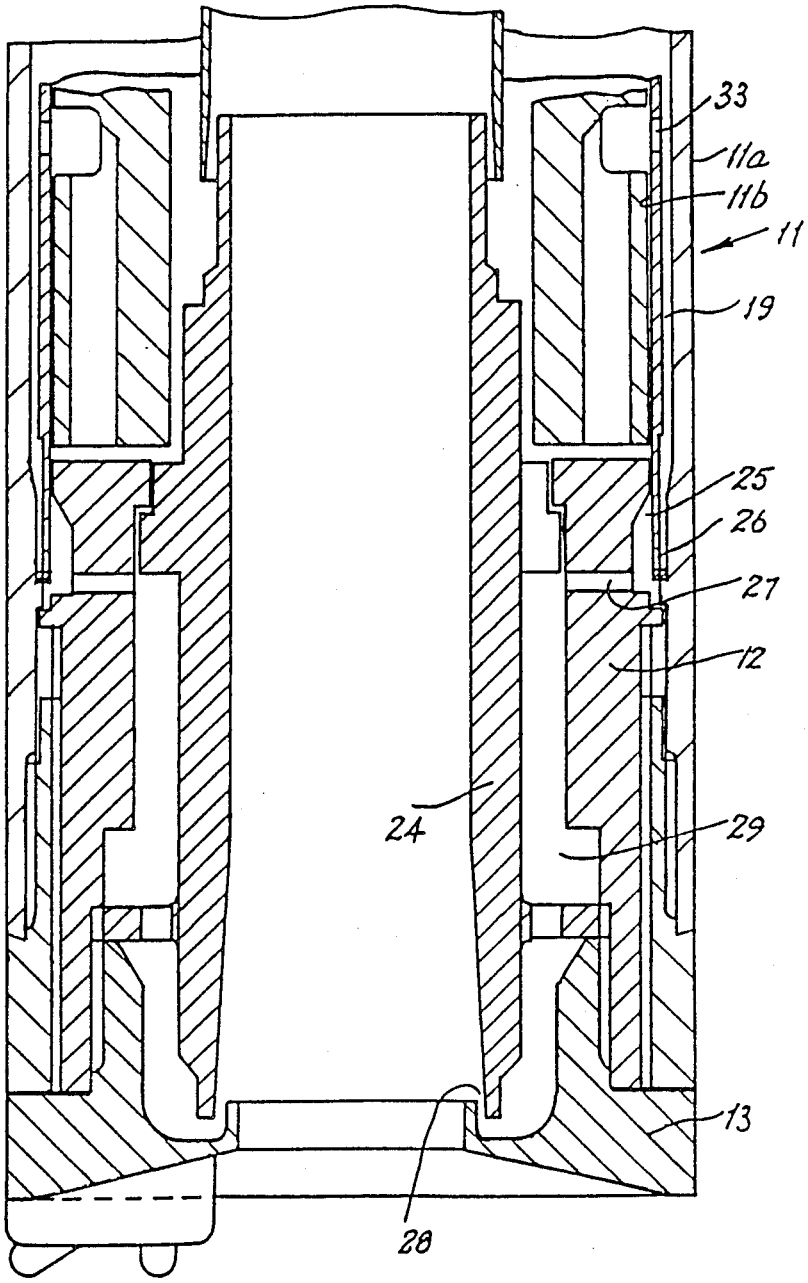
FIGS. 5A and 5B are enlarged views of the juction between the casing and drill bit support when the hammer is in the operative position and blow down position respectively.
Figure 5B:
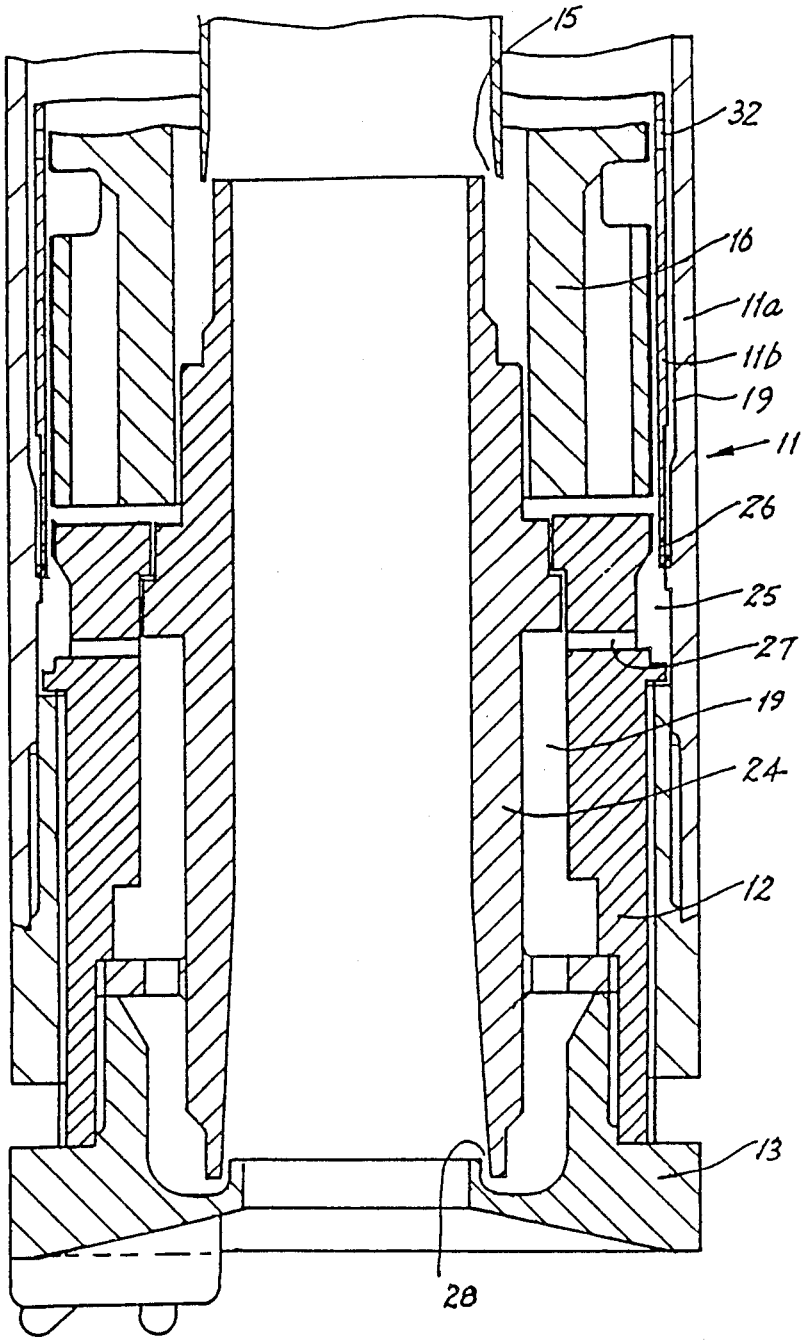

The passageway 19 between the inner and outer portions 11*a* and 11*b* of the casing extends to the inner most end of the drill bit support 12 and opens into a third set of circumferentially spaced inlet ports 26 at the lower end of the inner portion 11*b* of the casing. The inner end of the drill bit support 12 is formed with a waisted portion 25 and the third inlet ports 26 open into the waisted portion when the drill bit support is both in its operative position (FIGS. 1, 2 and 3) and when the drill is in its "blow down" position (FIG. 4). The third inlet ports 26 communicate with a series of radially directed ports 27 in the drill bit support through the waisted portion 25. The radial ports 27 in the drill bit support 12 are open at their innermost end into a passageway 29 between in the internal face of the drill bit support 12 and the external face of the inner liner 24. The passageway 29 opens into the central passageway of the inner liner via an annular opening 28 provided between the drill bit 13 and the lower end of the inner liner 24. The portion of the drill bit 13 adjacent the lower end of the inner liner 24 is flanged such that fluid flow from the passageway 29 into the central passageway is directed through the central passageway away from the drill bit 13.

In operation of the drill bit is initially considered in its impact position as shown at FIG. 1 fluid is admitted into the space defined between the anvil 17 and the lower end of the piston 16 through the second inlet ports 32 and the lower waisted portion 22 in the piston and the ports 23. The build up in pressure in that region causes the piston 16 to be lifted from the anvil and moved towards the raised position. During such upward movement any fluid trapped between the top sub and the upper end of the piston 16 escapes from the space through the second exhaust 31 and into the central passageway. On the piston reaching an intermediate position as shown at FIG. 2 the uppermost end of the piston 16 engages the lower end of the exhaust tube 30 to seal the upper portion of the annular space and the second inlet ports 32 are closed off. With further upward movement of the piston 16 fluid communication is made between the first inlet ports 20 and the upper portion of the annular space through the upper waisted portion 21 and ports 23 of the piston 16. As a result of inertia the piston will continue its upward movement to be slowed down by pressure build up in the space defined between the upper end of the piston 16 and the upper end of the annular space. The resultant pressure build up produces a down thrust on the piston causing it to be driven towards the anvil to the position as shown in FIG. 1. During the upward movement of the piston 16 and subsequent to the intermediate position shown in FIG. 2 the piston moves out of sealing engagement with the inner liner 24 of the drill bit support 12 and fluid from the lower annular space escapes to the central passageway through the first exhaust 15.

On cessation of drilling the top sub and casing are lifted away from the bottom of the bore hole causing the drill bit support 12 to drop in the lower end of the casing to a lower most position in the casing as shown at FIG. 4. At this position the piston 16 is retained in the impact position with the anvil 17 since the second inlet ports 32 are sealed from communication with the lower end of the piston 16 as the lower waisted portion 22 has moved beyond the second inlet port 32. The first inlet ports are opened to a limited extent to the upper portion of the annular space since the upper end of the piston has moved beyond the upper limit of the first inlet ports 20. The upper end of the piston however is spaced from the lower end of the exhaust tube 30 to permit the escape of fluid in the upper portion to the second exhaust 31. The fluid communication however is maintained as a central bore of the hammer for the fluid bypass from the top sub since the third set of inlet ports 26 remain in communication with the waisted portion 25 of the inner end of the drill bit support 12.

Throughout the operation of the hammer additional fluid to that used in effecting reciprocation of the piston 16 is continuously supplied to the lower end of the central passageway through the hammer to be directed upwardly therein. This flow is maintained during "blow down". As a result of this upward fluid flow within the central passageway any cuttings produced by the drilling operation are carried from the area of drilling upwardly to the bore of the central tube and thus to the drill string. This flow is enhanced during drilling by the upward flow of exhaust fluid from the first and second exhaust 15 and 31 which result from the operation of the hammer.

It should be appreciated that the scope of the present invention should not be limited to the particular scope of the embodiment described above. In particular it should be noted that while reference throughout the specification is made to an upper and lower end such references are made purely for assistance in description and is not intended to be limiting upon the embodiment of the invention or its application.

The claims defining the invention are as follows, I claim:

1. A down hole hammer comprising a substantially cylindrical casing having a top sub at one end and a drill bit support at the other end, a central passageway defined at least in part by a central tube having an extension extending through said top sub, said casing and said drill bit support said central tube defining an annular space between the internal face of the casing and the extension of said central tube, an annular piston reciprocately supported within the annular space for movement between an impact position at which said piston abuts said drill bit support and a raised position at which said piston is spaced from said drill bit support, fluid porting means from a source of fluid under pressure to said annular space to effect the reciprocation of the piston between the raised and impact positions, exhaust means for exhausting fluid from the annular space during reciprocation of said piston into said central passageway, and a fluid bypass extending between the top sub and the drill bit support and having an outlet opening into the central passageway of said drill bit support directed towards said top sub, said exhaust means comprising first exhaust extending from the end of said annular space adjacent said drill bit support and opening into the central passageway at a position inward of the fluid bypass outlet opening and a second exhaust extending from the other end of the annular space remote from the drill bit support and opening into said central passageway at a position inward of said first exhaust, said first and said second exhaust discharging into the central passageways towards said top sub.

2. The down hole hammer as claimed at claim 1 wherein the central tube extends from the top sub and terminated at the upper end of the drill bit support, wherein the upper end of the drill bit support is formed as an annular spigot sealingly engaged with the inner bore of the piston when the piston is at its impact position and for a portion of travel of said piston from the impact position, the upper end of said drill bit support being spaced a small distance from the lower end of the central tube to provide for the first exhaust.

3. The down hole hammer as claimed at claim 2 wherein a second tube is mounted to the top sub and concentrically surrounds the central tube and extends a portion of the length of the annular space, said second tube being engaged by the inner bore of the piston when said piston is in its raised position and for a portion of its travel of said piston from its raised position, a space being defined between the central tube and second tube, said space opening into the central passageway in the top sub and providing for said second exhaust.

4. The down hole hammer as claimed at claim 2 wherein said central passageway increases in diameter at the entry of the second exhaust into the central passageway.

5. The down hole hammer as claimed at claim 1 wherein a fluid passageway is provided in the wall of the casing, said passageway communicating at one end with the top sub and also communicating with said fluid porting means and with said bypass.

6. The down hole hammer as claimed at claim 5 wherein said fluid bypass is in communication with said passageway when said hammer is in its operative mode and its blow down mode.

* * * * *